US007284405B2

(12) United States Patent
Kanamaru et al.

(10) Patent No.: US 7,284,405 B2
(45) Date of Patent: Oct. 23, 2007

(54) PRESSURE CONTROLLED FLUID PRESSURE EXTRUSION METHOD

(75) Inventors: Hisanobu Kanamaru, Sagamihara (JP); Kazuto Kobayashi, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 391 days.

(21) Appl. No.: 10/431,114

(22) Filed: May 6, 2003

(65) Prior Publication Data

US 2004/0035168 A1 Feb. 26, 2004

Related U.S. Application Data

(63) Continuation-in-part of application No. 09/827,699, filed on Apr. 6, 2001, now abandoned.

(30) Foreign Application Priority Data

Jun. 9, 2000 (JP) ..... 2000-173006

(51) Int. Cl.
*B21C 23/00* (2006.01)

(52) U.S. Cl. ..... 72/253.1; 72/57; 72/271

(58) Field of Classification Search ..... 76/107.1; 72/57, 253.1, 271, 463
See application file for complete search history.

(56) References Cited

U.S. PATENT DOCUMENTS 796,970 A * 8/1905 Hoopes ..... 72/57
2,781,016 A * 2/1957 Livermont ..... 72/463
3,382,691 A 5/1968 Green
3,765,222 A 10/1973 Lundback
3,768,344 A * 10/1973 Feldcamp ..... 76/107.1
3,983,730 A * 10/1976 Fiorentino ..... 72/46

FOREIGN PATENT DOCUMENTS

GB 1215452 12/1970

* cited by examiner

*Primary Examiner*—Derris H. Banks
*Assistant Examiner*—Debra Wolfe
(74) *Attorney, Agent, or Firm*—Darby & Darby P.C.

(57) ABSTRACT

The lower part of a material to be molded forms a lower, seal with a die. A punch applying a molding force to the material forms an upper seal with the perimeter of the die. The space between the upper and lower, seals forms a pressure chamber that is filled with a fluid. As the punch descends into the die, the fluid is pressurized. The lower seal is a complete seal to prevent leakage of fluid into the die. The upper seal is given a clearance with the die that permits controlled leakage of fluid therepast at a rate that limits the maximum pressure in the pressure chamber while permitting the development of an adequate pressure on the material being molded.

14 Claims, 3 Drawing Sheets

PRESSURE CONTROLLED FLUID PRESSURE EXTRUSION METHOD

CROSS-REFERENCE TO RELATED APPLICATION

This application is a continuation-in-part of U.S. patent application Ser. No. 09/827,699 filed Apr. 6, 2001, now abandoned, which is hereby incorporated by reference in its entirety.

BACKGROUND TO THE PRESENT INVENTION

The present invention relates to a pressure controlled fluid pressure extrusion method. The term "fluid pressure extrusion method" defines a method in which extrusion is conducted under the action of fluid pressure. Pressure control describes the adjustment of this fluid pressure in order to conduct proper extrusion. These extrusions can be used to make parts for automobiles such as helical gears and the like.

Examples of the prior art include forward extrusion methods as shown in FIG. 1 of Japanese Laid-Open Patent Publication Number 11-254082 and FIG. 3 of Japanese Laid Open Patent Publication Number 7-308729.

Referring to FIGS. 3(A)-3(D), the essentials of these prior art methods are schematically shown in order to compare these methods of the prior art with the present invention. A material 11 progresses through the steps of 3(A), 3(B), 3(C), and 3(D) to produce a manufactured product 15. Because the example of product 15 is perforated, material 11 is also perforated and a mandrel present in the metal mold.

Referring to FIG. 3(A), the outer diameter of material 11 is approximately the same size as the inner diameter of a container 12*b*. Referring to FIG. 3(C), when material 11 is extruded into a die 12 and molded by a punch 13, a large frictional force is generated between the material outer diameter and the container. Furthermore, when molding helical gear part 15*a* of manufactured product 15 with a helical gear part 12*a* of die 12, product 15 rotates as it advances along a lead. This rotation adds a large additional frictional force in the direction of rotation as well as the frictional force in the axial direction as described above. As a result, the load needed for working is increased, and there are negative effects on the product precision and on the die life. With this method, the outer diameter part of the material must be straight. If the outer diameter is tiered, the smaller diameter part could become deformed and expand during molding, and the specified molding cannot be conducted.

OBJECTS AND SUMMARY OF THE PRESENT INVENTION

The first object of the present invention is to lengthen the life of the die.

The second object is to improve product precision.

In the present invention, a fluid pressure is disposed between the die and the material.

When molding the material, a suitable fluid pressure acts upon the material.

Briefly stated, the present invention provides a fluid pressure molding method in which the lower part of a material to be molded forms a lower seal with a die. A punch applying a molding force to the material forms an upper seal with the perimeter of the die. The space between the upper and lower seals forms a pressure chamber that is filled with a fluid. As the punch descends into the die, the fluid is pressurized. The lower seal is a complete seal to prevent leakage of fluid into the die. The upper seal is given a clearance with the die that permits controlled leakage of fluid therepast at a rate that limits the maximum pressure in the pressure chamber while permitting the development of an adequate pressure on the material being molded.

Described in more detail, according to an embodiment of the invention, a suitable fluid pressure acts on the outer perimeter surface of a material. The material is pushed directly by a punch into a die for molding, whereby the material is molded into a desired, shape.

According to a feature of the invention, the fluid is suitably sealed by the material, the die, and the punch. The action of the die and the punch compresses and pressurizes the fluid. The fluid pressure acts on the material to form the product.

According to an additional feature of the invention, the fluid pressure is adjusted by a clearance of the die and the punch. The clearance between the die and the punch is formed by machining. The machined dimension of the clearance between the die and the punch takes into account the elastic deformation in the radial direction of the die and the punch at a predetermined fluid pressure. Since the upper seal is machined to tolerance to form the seal, the upper seal does not require an additional O-ring. The machining process also alleviates the need for sleeves or the like that are inserted into the die. The sleeves are disposable forms of the die that can form the seal.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1A:
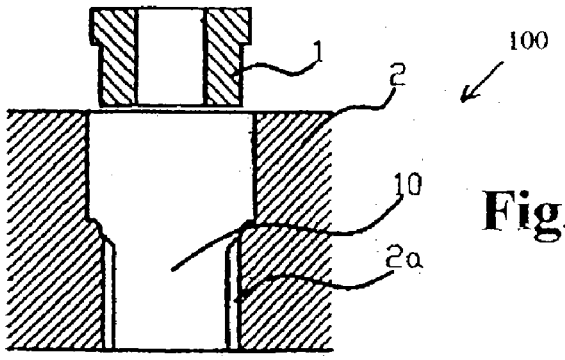
FIGS. 1(A) through 1(D) are drawings of the steps in the process according to an embodiment of the invention.

Referring to FIGS. 1(A)-1(D), the process of molding material 1 into molded product 5 is shown. A metal mold 100 is constructed from a die 2, a punch 3, and a mandrel 4. The metal mold 100 is set into a conventional press (not shown). The metal mold 100 is actuated by the ascending and descending motion of a slide of the press.

Referring to FIG. 1(A), die 2 includes a cavity 10 having the shape of the desired molded product. In the illustrated embodiment, the molded product is a helical gear. Teeth 2*a* are formed on the lower part of cavity 10. Teeth 5*a* of molded product 5 are formed by teeth 2*a*.

Figure 1B:
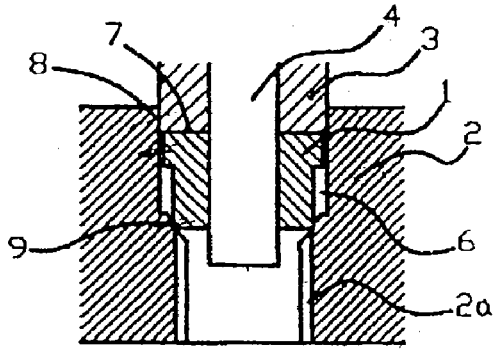
Figure 2:
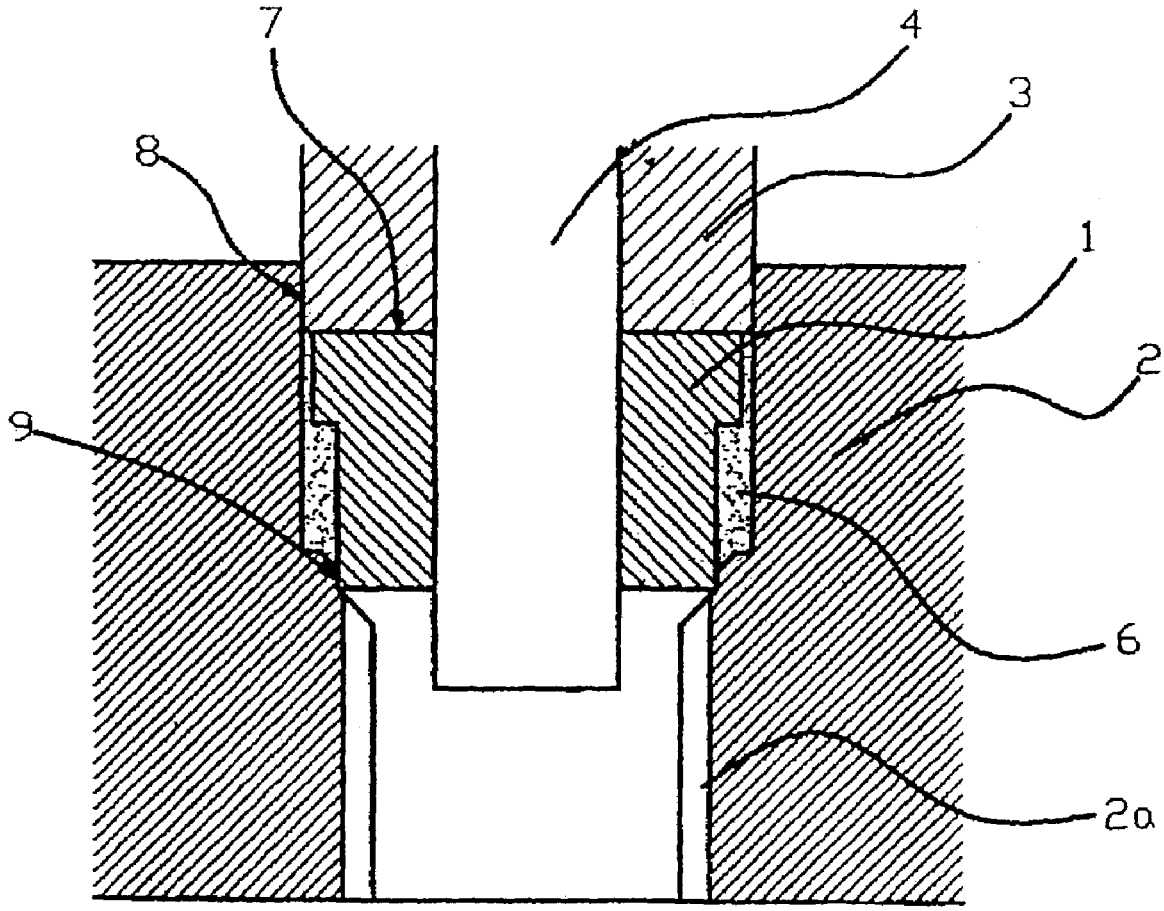
FIG. 2 is an expanded view of the principal part of FIG. 1(B).
Figure 3A:
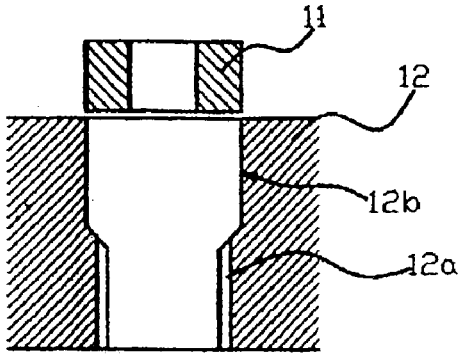
PRIOR ART Fig. 3(A)
FIGS. 3(A) through 3(D) are drawings illustrating the method of the prior art.
Figure 3B:
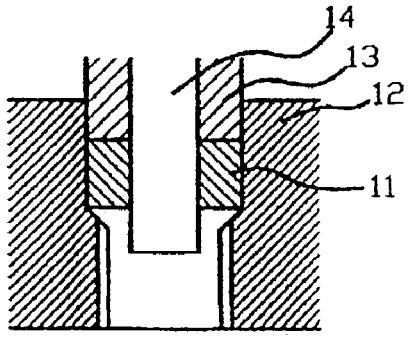
PRIOR ART Fig. 3(B)
Figure 3C:
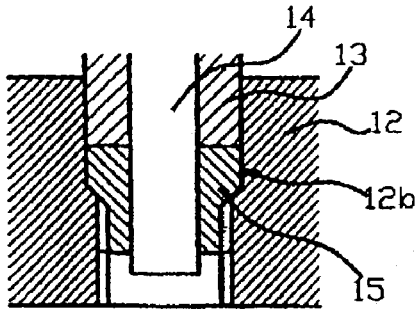
PRIOR ART Fig. 3(C)
Figure 3D:
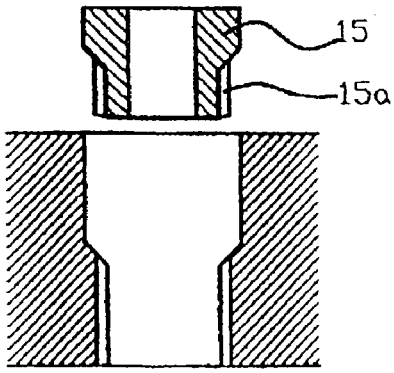
PRIOR ART Fig. 3(D)

Referring to FIG. 1(B) and FIG. 2, material 1 is supplied to die 2. Material 1 is transported to die 2 by a transport device and is inserted into cavity 10 of die 2. After inserting material 1 into cavity 10, mandrel 4 is inserted into the hole of material 1. A fluid is supplied to cavity 10. In the present embodiment, oil is used as the fluid.

Next, punch 3 is lowered into cavity 10. The lower end surface of punch 3 contacts the upper surface of material 1.

As punch 3 descends further, a fluid pressure chamber 6 is sealed between the punch 3 and the lower portion of the material 1. With further descent of punch 3 the fluid inside cavity 10 is compressed. In other words, the fluid is sealed by a first seal 7 at the contact surface between material 1 and punch 3, a second seal 8 at the insertion surface between die 2 and punch 3, and a third seal 9 at the insertion surface between die 2 and the lower end of material 1.

Seal 9 must completely seal to prevent leakage of fluid from fluid pressure chamber 6 to the portion of the cite 2 containing the teeth 2*a*. If the pressurized fluid from fluid pressure chamber 6 penetrates into teeth 2*a*, the presence of the material 1 may produce partial depressions in teeth 5*a* of molded product 5. This would prevent achieving the desired shape.

Seal 7 may have some leakage without producing any problems. In the present embodiment, because teeth 2*a* are a helical gear, while molding, material 1 rotates with respect to punch 3. As punch 3 advances, a film of fluid penetrates between the teeth 2*a* and the teeth 5*a* being formed. The resulting lubrication reduces the frictional force that accompanies this rotation.

With seal 8, the pressurized fluid must be actively released. If the fluid pressure in fluid pressure chamber 6 rises without limit, there can be problems such as the rupture of members such as die 2 and the like. However, if a large amount of fluid in fluid pressure chamber 6 leaks from seal 8, material 1 expands radially. This can cause problems such as incomplete molding action of material 1. Taking these points into account, it is necessary to determine the clearance for the restriction of seal 8. Seal 8 acts as a relief valve.

As described above, the clearance of seal 8 is determined so that an optimal fluid pressure of fluid pressure chamber 6 is achieved. The clearance between die 2 and punch 3 is formed by machining. The machined dimension of the clearance between die 2 and punch 3 takes into account the elastic deformation in the radial direction of die 2 and punch 3 at a predetermined fluid pressure. Since seal 8 is machined to tolerance to form the seal, seal 8 does not require an additional O-ring.

Figure 1C:
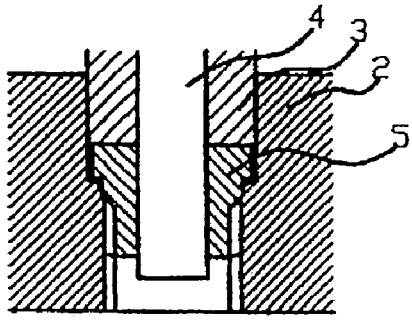

Referring to FIG. 1(C), while fluid pressure from fluid pressure chamber 6 is applied to material 1, material 1 is pushed by punch 3 to become molded into molded product 5. In this situation, because the fluid in fluid pressure chamber 6 is disposed between die 2 and material 1, frictional forces are not generated between the two. Therefore, material 1 is molded with only the pushing pressure that is needed for molding. In the present embodiment, because teeth 2*a* of die 2 form a helical gear, material 1 is rotated while being pushed into die 2. However, due to the action of the above fluid, the frictional resistance associated with the rotation is not generated.

Figure 1D:
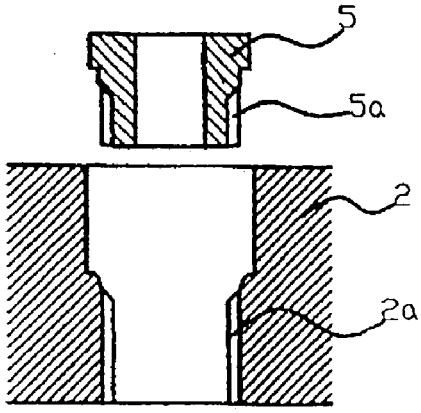

Referring to FIG. 1(D), molded product 5 inside die 2 is impelled from below by a knockout device (not shown) and is removed from above die 2. In other words, the molded product is lifted to the top of die 2 by a rotatable lifting member.

In the present embodiment, a tiered material is used, but the present invention can be used for a straight material as well. Although there is a hole in the center of the molded product, the present invention does not require a hole. In the present embodiment, the molded product is a helical gear, but the present invention can be used for molded parts with super gears or with no gears as well.

According to the present invention, because there is no associated frictional force, the load needed for molding is reduced. As a result, the stress on the die is reduced, and product precision is improved. There are advantages such as having a die with a long life and conserving energy. Furthermore, even if there is a space between the die and the material, there is no deformation of the material. As a result, extrusion of tiered materials becomes possible. As a result, the cross-section reduction rate for the extrusion is small, and the molding load is further reduced.

The fluid pressure in fluid pressure chamber 6 is controlled by the clearance of seal 8. As a result, control is easy and stable. The present invention permits molding of parts that have heretofore been considered difficult to process.

Having described preferred embodiments of the invention with reference to the accompanying drawings, it is to be understood that the invention is not limited to those precise embodiments, and that various changes and modifications may be effected therein by one skilled in the art without departing from the scope or spirit of the-invention as defined in the appended claims.

What is claimed is:

1. A pressure controlled fluid pressure extrusion method comprising:

placing a material to be molded in a die;

sealing a fluid by a first seal and a second seal in an area between said die and an outer perimeter of said material;

forming said first seal by contacting said material and said die, wherein said first seal is a complete seal which prevents any leakage therepast of any of said fluid;

machining a clearance between said die and said punch, wherein said clearance forms said second seal which is an incomplete seal permitting leakage of said fluid therepast to control the pressure of said fluid;

applying a fluid pressure to an outer perimeter of said material;

pushing said material directly by a punch into said die for molding, whereby said material is molded into a desired shape; and removing said material by lifting said material out of the die.

2. A pressure controlled fluid pressure extrusion method according to claim 1, wherein the step of applying includes compressing and pressurizing said fluid by an action of said die and said punch.

3. A pressure controlled fluid pressure extrusion method according to claim 2, wherein the step of machining includes adjusting said clearance to adjust said leakage to control the pressure of said fluid.

4. A pressure controlled fluid pressure extrusion method comprising:

placing a material to be molded in a die;

sealing a fluid in an area between said die and an outer perimeter of said material by a first seal formed by contact between said material and said die and a second seal formed by contact between said die and a punch, wherein said first seal is a complete seal which prevents any leakage there past of any of said fluid and said second seal is an incomplete seal having a clearance between said die and said punch which permits leakage of said fluid there past to control the pressure of said fluid, said clearance being formed by machining and accounting for elastic deformation of at least one of the die and the punch;

applying a fluid pressure to an outer perimeter of said material; and pushing said material directly by a punch into said die for molding, whereby said material is molded into a desired shape.

5. A pressure controlled fluid pressure extrusion method according to claim 4, wherein the step of applying includes compressing and pressurizing said fluid by an action of said die and said punch.

6. A pressure controlled fluid pressure extrusion method according to claim 5, wherein the step of machining includes adjusting said clearance to adjust said leakage to control the pressure of said fluid.

7. The pressure controlled fluid pressure extrusion method according to claim 4, wherein the desired shape is a gear.

8. The pressure controlled fluid pressure extrusion method according to claim 4 further comprising the step of forming a fluid pressure chamber between the punch and a lower portion of the material.

9. The pressure controlled fluid pressure extrusion method according to claim 4 further comprising the step of placing a mandrel in a hole in said material.

10. A pressure controlled fluid pressure extrusion method comprising:

placing a material to be molded in the cavity of a die, said cavity including a desired shape;

sealing a fluid by a first seal and a second seal in an area between said die and an outer perimeter of said material;

forming said first seal by contacting said material and said die, wherein said first seal is a complete seal which prevents any leakage therepast of any of said fluid;

machining a clearance between said die and said punch, wherein said clearance forms said second seal which is an incomplete seal permitting leakage of said fluid therepast to control the pressure of said fluid;

pressurizing the fluid in the cavity; and pushing said material directly by a punch into said die for molding, whereby said material is molded into the desired shape.

11. The pressure controlled fluid pressure extrusion method of claim 10 wherein the desired shape is a gear.

12. The pressure controlled fluid pressure extrusion method of claim 10 wherein the desired shape is a helical gear.

13. The pressure controlled fluid pressure extrusion method of claim 1 further comprising the step of rotating the material as it is pushed into the die.

14. The pressure controlled fluid pressure extrusion method of claim 1 wherein the desired shape is a gear.

* * * * *